US006997005B2

(12) United States Patent
Haasis

(10) Patent No.: US 6,997,005 B2
(45) Date of Patent: Feb. 14, 2006

(54) EFFICIENT COOLING SYSTEM

(75) Inventor: Hans Haasis, Downey, CA (US)

(73) Assignee: Omniteam Inc., Downey, CA (US)

( * ) Notice: Subject to any disclaimer, the term of this patent is extended or adjusted under 35 U.S.C. 154(b) by 12 days.

(21) Appl. No.: 10/802,082

(22) Filed: Mar. 12, 2004

(65) Prior Publication Data

US 2005/0198987 A1 Sep. 15, 2005

(51) Int. Cl.
*F25D 23/12* (2006.01)

(52) U.S. Cl. ..... 62/258; 62/298

(58) Field of Classification Search ..... 62/225, 62/298, 302, 414, 419, 426, 428, 429
See application file for complete search history.

(56) References Cited

U.S. PATENT DOCUMENTS 2,139,500 A * 12/1938 Hughes ..... 62/302
2,182,664 A * 12/1939 Gowans ..... 62/525
2,198,931 A * 4/1940 Carstensen et al. ..... 62/302
3,230,733 A * 1/1966 Rutishauser et al. ..... 62/256
4,457,140 A * 7/1984 Rastelli ..... 62/261
4,630,530 A * 12/1986 Eckstrom et al. ..... 454/100
4,907,419 A * 3/1990 Kruck et al. ..... 62/263
5,277,039 A 1/1994 Haasis

* cited by examiner

*Primary Examiner*—William E. Tapolcai
(74) *Attorney, Agent, or Firm*—Fulwider Patton LLP

(57) ABSTRACT

An efficient refrigeration system for mounting on the wall of a food storage structure, includes cooling coils and heat exchange vanes, and a lower inlet and an upper outlet. A centrifugal fan and motor are removably mounted as a sub-unit on mating tracks, on the sub-unit and the housing, and are held in place by quick release arrangements, for ease in repair and/or replacement of the sub-unit. An expansion valve for the refrigeration system is mounted near the inlet. An additional fan for cooling the electric motor forms part of the sub-unit.

9 Claims, 3 Drawing Sheets

FIG. 1
(Prior Art)
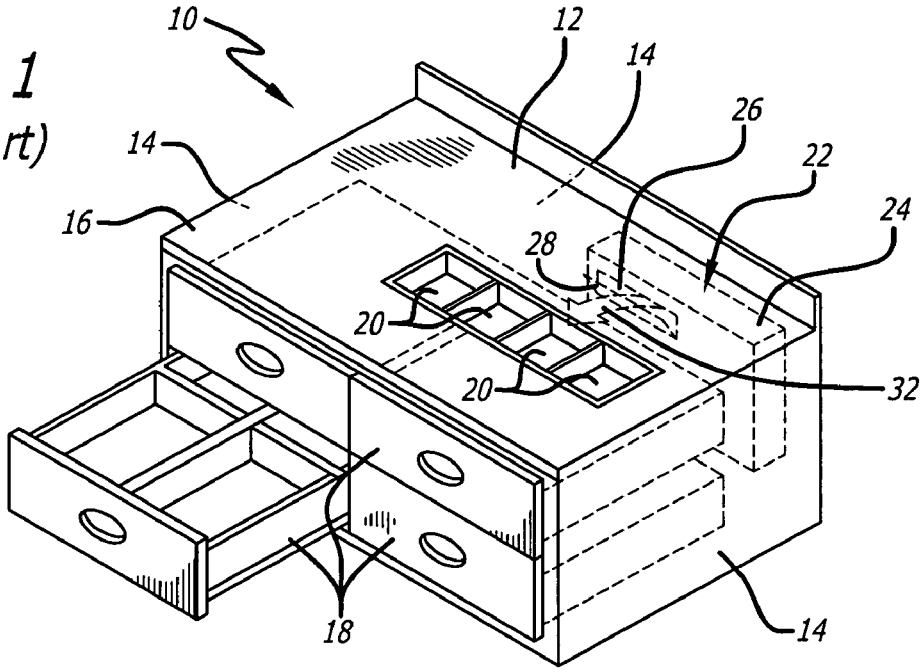
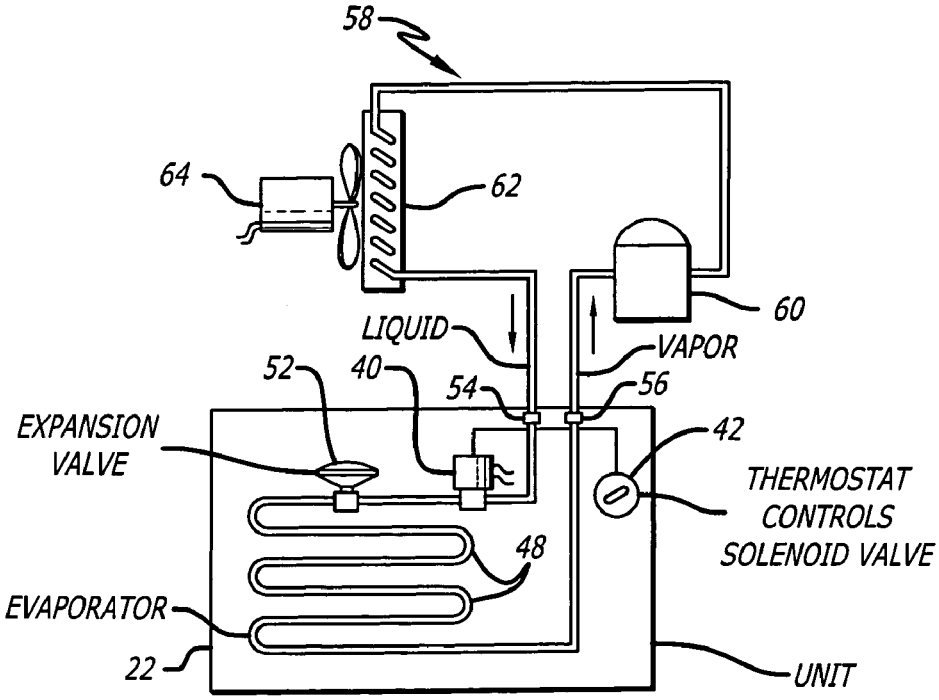
FIG. 2
(Prior Art)

EFFICIENT COOLING SYSTEM

RELATED PATENTS

This invention is related to Hans Haasis U.S. Pat. No. 5,277,039, granted Jan. 11, 1994 and entitled Cabinet Refrigeration Unit.

FIELD OF THE INVENTION

This invention relates to refrigeration units, and more particularly to such units which are self-contained and suitable for removable mounting in standard types of food storage and dispensing cabinets or structures.

BACKGROUND OF THE INVENTION

In one prior art refrigeration unit, as shown in U.S. Pat. No. 5,277,039, granted Jan. 11, 1994, and cited above, a refrigeration unit is disclosed for mounting in a food storage cabinet or structure. The unit has cooling coils, and a centrifugal fan for directing cooled air into the cabinet, and toward food trays mounted in the cabinet. The overall operation of the refrigeration system is of a type generally known, with coolant such as Freon or other similar refrigerant being condensed into a liquid state by an external compressor and condenser, and then supplied to the refrigeration unit. In the refrigeration unit, an expansion valve is provided and the resultant cold refrigerant from the expansion valve is supplied to heat exchange coils. The fan mentioned above draws room temperature air across the coolant coils and directs the refrigerated air toward food pans or other areas where cooling is desired. The expansion valve was located near the fan in the path of cold air from the refrigeration coils.

Under adverse conditions, however, involving high humidity, for example, frost or ice would build up on the expansion valve. With the expansion valve located adjacent to the centrifugal fan and toward the output from the coolant coils, the frost or ice build-up would, on some rare occasions and interfere with the rotation of the centrifugal fan.

The centrifugal fan and the electric motor for it are the only moving parts of the refrigeration unit; and in the system of U.S. Pat. No. 5,277,039 the fan and the electric motor were firmly secured into the entire refrigeration assembly. Accordingly when the fan or electric motor required removal for servicing or replacement, it was a time consuming project.

SUMMARY OF THE INVENTION SUMMARY

Accordingly, objects of the invention involve overcoming the disadvantages outlined above.

In accordance with one specific illustrative embodiment of the invention, the location of the expansion valve has been shifted to a point away from the fan and close to the warm air input to the refrigeration unit. With this arrangement frost does not build up on the expansion valve, and there is no possible interference with the centrifugal fan. In addition, the sub-unit including the fan and its associated electric motor are mounted on tracks, and are held in place by quick release arrangements, so that they may be quickly and readily disassembled from the remainder of the refrigeration unit. The tracks and quick release holding arrangements may take various configurations, but the tracks may be slots formed in the housing, mating with flanges on the fan and motor sub-unit, and with bent springy metal strips providing a convenient preferred construction for holding the fan-motor subassembly firmly in place on the slots forming the track.

Viewed from a different aspect, the following features may be noted;

1. In a cabinet mounted refrigeration unit, locating the expansion valve at the air inlet, and away from the fan.

2. In a refrigeration unit for mounting in a food service cabinet or the like, providing a track mounted sub-unit including the fan and the associated motor.

3. In a refrigeration unit for mounting in a food service cabinet or the like, providing slots on the refrigeration system housing, mating flanges on the fan sub-unit, and quick release arrangements for holding the sub-unit in a fixed location in the housing.

Viewed from a somewhat different aspect, a self contained refrigeration unit for mounting in a food storage cabinet or structure includes a refrigeration unit including a housing containing refrigeration coils and cooling vanes, with the housing being fairly thin, preferably less than six inches deep, and having a lower inlet and an upper outlet. An expansion valve is mounted to the housing near the inlet. A sub-unit including a centrifugal fan and an electric motor is mounted to the housing in a readily removable manner, preferably by mating tracks. In addition quick release arrangements, preferably springy metal strips, hold the sub-unit firmly in place within the housing. An additional fan to cool the electric motor may form an additional part of the removable sub-unit.

Other objects, features and advantages of the invention will become apparent fro a consideration of the following detailed description, and from the associated drawings.

BRIEF DESCRIPTION OF THE DRAWINGS

FIG. 1 shows a known food storage cabinet with a refrigeration unit;

FIG. 2 shows a classical refrigeration system using a known type of gas/liquid refrigerant;

DETAILED DESCRIPTION OF THE PREFERRED EMBODIMENTS

While the specification describes particular embodiments of the present invention, those of ordinary skill can devise variations of the present invention without departing from the inventive concept.

Figure 3:
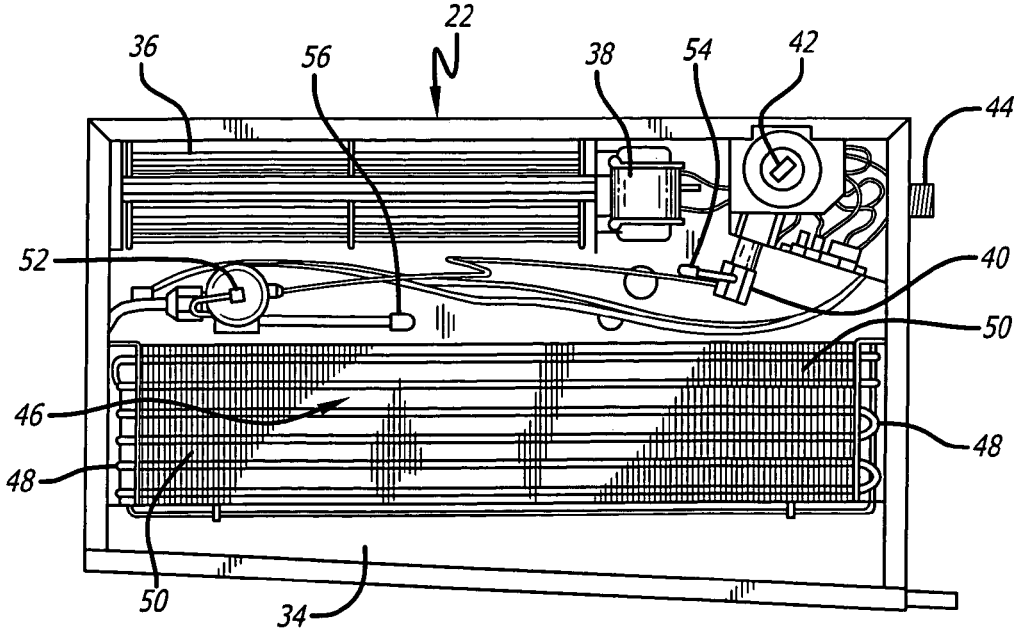
FIG. 3 (Prior Art)
FIG. 3 is a prior refrigeration unit which may be employed in the system of FIG. 1.
Figure 5:
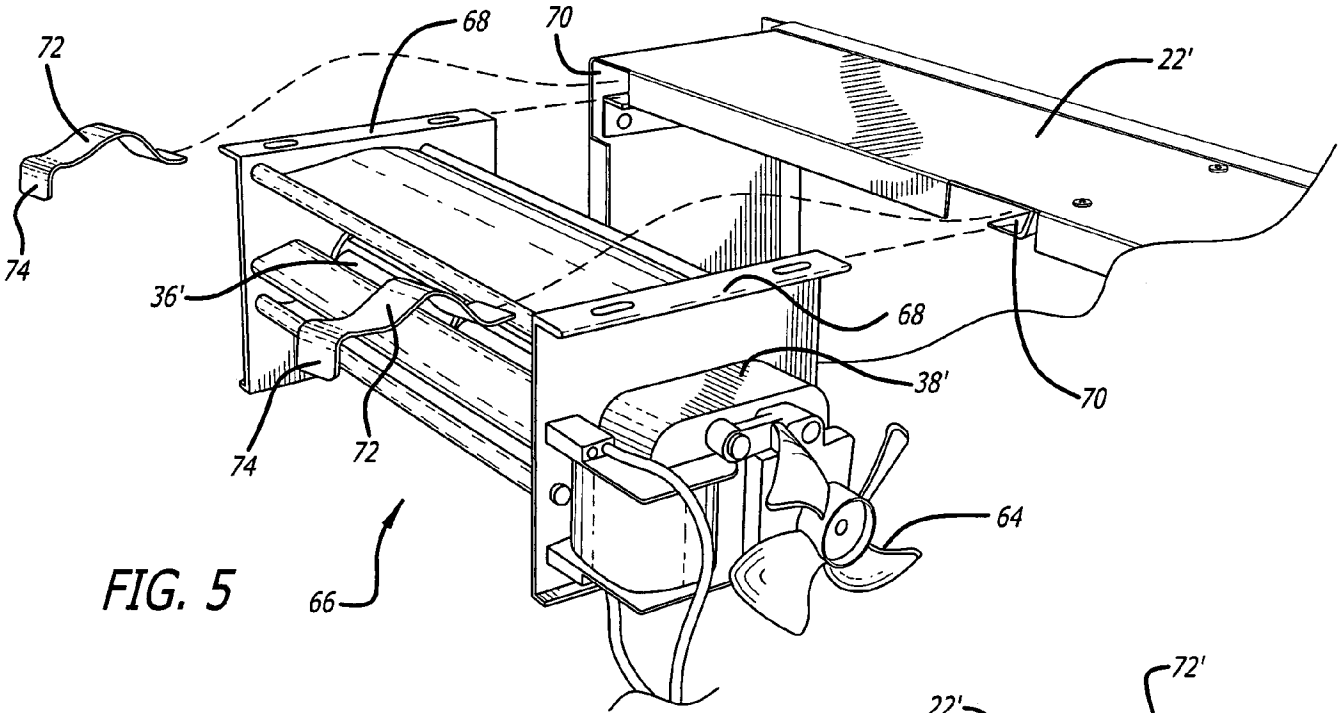
FIG. 5 is an enlarged showing of a portion of FIG. 4, with the fan and electric motor sub-unit shown removed from the refrigeration housing.

In the present patent application, FIGS. 1, 2 and 3 are drawn directly from FIGS. 1, 5 and 9 of my prior U.S. Pat. No. 5,277,039, cited above; and the specification of that prior patent will therefore be repeated substantially as set forth in that prior patent.

Referring more particularly to the drawings, FIG. 1 is a perspective view of a cabinet refrigeration system 10, showing a cabinet 12 having side walls 14, a top wall 16 and drawers 18 and bins 20 for food storage or display. It is to be understood that cabinet 12 may included methods of food storage or display, such as shelves, sliding racks and the like, other than those specifically shown in FIG. 1. A refrigeration unit 22 having a housing 24 and an elongated output vent 26 toward the top of the housing 24 is removably mounted on the inside of a side wall 14 of cabinet 12. A deflector or cold-air-director vane 28 is mounted on housing 24 at output vent 26.

In accordance with one embodiment of the invention, refrigeration unit 22 may be mounted on the inner surface of the rearmost side wall of cabinet 12, with output vent 26 and deflector 28 oriented to direct the flow of cold air upward to the bottom surfaces of bins 20 and over the top of the food storage drawers 18 as indicated by arrow 32. It may be noted that in the preferred embodiment refrigeration depth of not more than about 6 inches, thereby providing a refrigeration unit 22 that does not take up any significant amount of the usable space inside cabinet 12, and is easily removed, replaced or interchanged with other refrigeration units.

It is to be understood that the direction of air flow out of output vent 26 may be adjusted by suitably positioning deflector 28 so that the direction of air flow meets the needs of the particular cabinet in which refrigeration unit 22 is installed.

It is to be further understood that deflector 28 may either be fixed or may be adjustable to suit the needs of a particular cabinet refrigeration system.

As seen in FIG. 3, refrigeration unit 22 has an elongated input opening 34 extending adjacent to the lower portion of housing 24. Warm air is drawn into refrigeration unit 22 through input 34, cooled by the refrigeration unit 22 and expelled through output vent 26. In accordance with the preferred embodiment of the invention, output vent 26 is located at the topmost portion of housing 24 to allow for the most efficient operation of refrigeration unit 22 and to facilitate the directing of cool air against surfaces of the drawers 18 and bins 20 of cabinet 12 which are most in need of cooling, and over the top of the drawers and shelves within the cabinet. With cold air normally falling and hot air rising, directing cold air over the top of the drawers and shelves insures cooling of the entire contents of the cabinet.

Refrigeration unit 22 includes an elongated centrifugal fan 36 powered by motor 38 and located immediately behind and in substantial alignment with output vent 26 in housing 24. Baffles are provided to direct air from centrifugal fan 36 out vent 26 at the top of refrigeration unit 22. A solenoid valve 40 controlled by thermostat 42 and sensing coil 44 is contained in refrigeration unit 22. In accordance with one embodiment of the invention, thermostat 42 extends through housing 24 to be accessible for adjustment o the outside of housing 24. Also, sensing coil 42 extends through housing 24 to monitor the temperature within cabinet 10.

Also contained within housing 24 of refrigeration unit 22 is an evaporator assembly 46 including evaporator tubing 48 and cooling vanes 50, an expansion valve 52 and coolant material input and output tubes 54 and 56, respectively.

As is best illustrated in the schematic diagram of FIG. 2, refrigeration unit 22 functions as follows:

Coolant material of a suitable type such as Freon is contained in a closed-loop circulation system 58. Coolant material in liquid form enters refrigeration unit 22 through coolant input tube 54. The flow of liquid coolant material through input tubing 54 is controlled by solenoid 40. Solenoid 40 is in turn controlled by the interaction of sensing coil 44 and thermostat 42. Liquid coolant then passes through expansion valve 52 causing the coolant to expand into a gaseous state and thereby cooling down evaporation tubing 48, of evaporator assembly 46 (see FIG. 3). Cooling vanes 50 are in turn cooled by evaporation tubing 48 and warm air, as it is drawn in through input port 34, is cooled down as it passes around evaporator assembly 46. This cooled air is then forced out of housing 24 of refrigeration unit 22 into the inside of cabinet 12. The now gaseous coolant material exits refrigeration unit 22 through coolant output tubing 56 where it travels through closed loop circulation system 58 to a compressor 60. The coolant material is then compressed and run through a condenser in the course of which the coolant is reconverted to a liquid for circulation back into refrigeration unit 22. A fan assembly 64 provides for the conduction of heat away from condenser 62. It is to be noted that compressor 60, condenser 62 and fan assembly 64 are remotely located away from cabinet refrigeration system 10 and are normally located outdoors when cabinet refrigeration system 10 is located indoors. FIG. 2 is included for purposes of completeness, as systems of this general type are of course known per se.

As noted above, the foregoing description of FIGS. 1–3 were taken, with minor changes from descriptions of FIGS. 1, 9 and 5, respectively, of my U.S. Pat. No. 5,277,039.

In the operation of the system of FIGS. 1–3, in some cases, frost would build up on the expansion valve 52 and even interfere with the operation of fan 36. In accordance with one aspect of the present invention, it was determined that the location of the expansion valve 52 above the cooling structure 46 and adjacent fan 36 contributed to the problem. In addition, the centrifugal fan 36 and motor 38 occasionally required servicing or replacement, and these components were integrally mounted into the housing 24. This integral mounting made servicing and/or replacement of the fan 36 and/or motor 38, a time consuming process.

Figure 4:
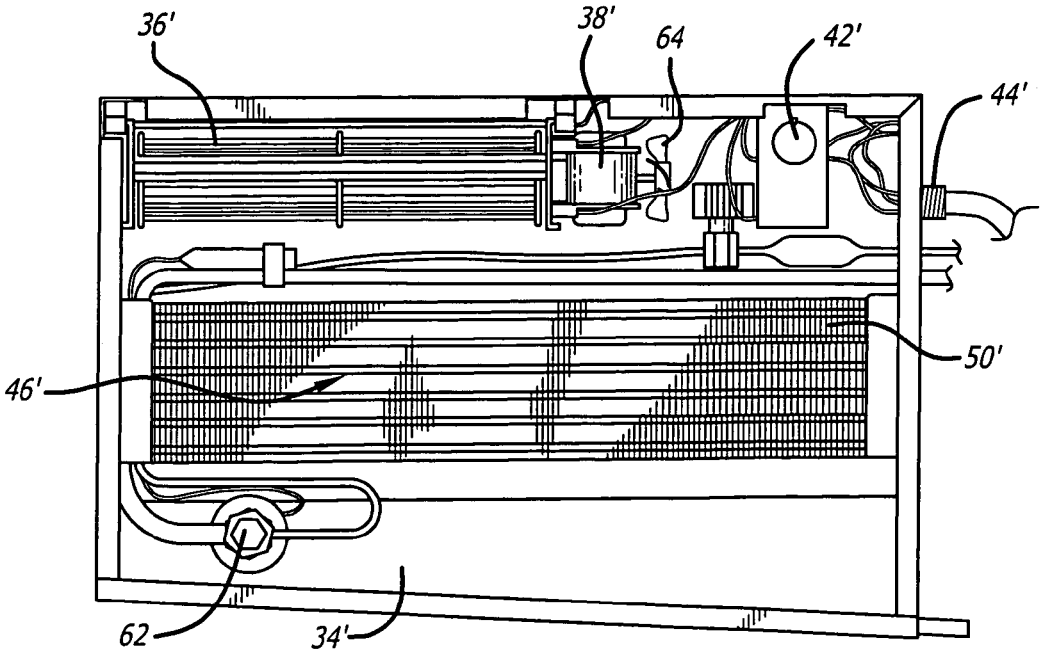
FIG. 4 is an improved refrigeration unit illustrating the principles of the invention.
Figure 6:
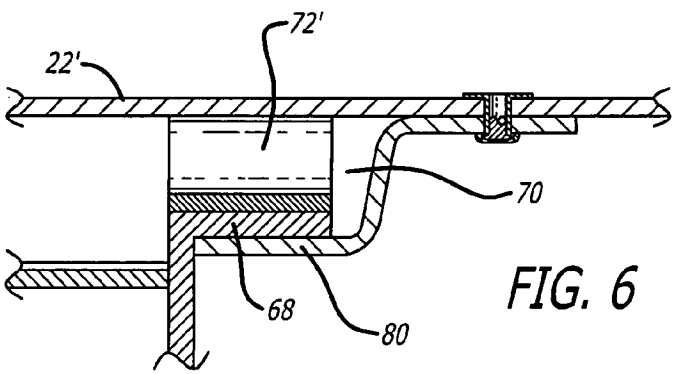
FIG. 6 is an enlarged showing of the mating tracks on the sub-unit and the housing, along with the resilient retention members.

Referring now to FIGS. 4, 5 and 6 of the drawings, the new design has overcome the problems outlined above. More specifically, concerning one matter, the expansion valve 62 has now been re-located to a position near the air inlet 34'. In this warmer location, frost does not build up to any substantial extent on the expansion valve; and on the rare occasion when some frost does build up, there is no interference with centrifugal fan 36'.

In addition, as shown in FIG. 5, the centrifugal fan 36', the electric motor 38' and the additional motor cooling fan 64 are mounted together in a sub-unit 66. In order to facilitate easy assembly and disassembly of the sub-unit 66 with the housing 22', the sub-unit 66 is provided with flanges or tracks 68, which mate with the tracks or slots 70 in the housing 22'. In practice, following sliding tracks or flanges 68 into the tracks or slots 70 in housing 22', springy metal strips 72 are inserted to overly the flanges 68, and firmly secure the sub-unit 66 into the housing 22'. The outer ends 74 of springy strips 72 are bent over perpendicular to the length of the strips 72 so that the strips may be readily removed using a big screw driver or the like. Following removal of the resilient strips 72, the sub-unit 66 may be readily slid out from the housing 22' so that the sub-unit may be serviced or replaced at the customer's location. With this new design, the mechanical removal and replacement of the sub-unit takes less than five minutes to accomplish.

FIG. 6 is an enlarged cross sectional view of a portion of the housing 22' showing the track or slot 70, and the mating flange 68 on the sub-unit 66. The springy metal strip 72 exerts pressure between the upper wall of housing 22' and the flange 68, holding the sub-unit firmly against the lower wall 80 of the housing slot 70. Accordingly, the mating flanges 68 and slot 70 form a support, guiding and alignment construction and the springy metal strips 72 provide a quick release arrangement.

Instead of using separate springy strips, the flanges 68 and/or the tracks 70 may be bent somewhat to make a tight or resilient fit; or separate resilient coil spring or other types of springs may be employed. Other quick release securing arrangements, such as an over-center latch or latches may be employed to hold the sub-unit 66 in place.

Concerning dimensions for the housing, one set of dimensions for a removably mounted refrigeration unit 22 which has been tested and found to be satisfactory involves units which are 13¾ inches high, 4½ inches deep and having a length between 16 inches and 24 inches, depending o the desired cooling capacity. However, these dimensions are not controlling and units which are longer, for example up to three feet long, and which are up to two feet high, could be used. However, as to depth, it is desirable that the units be relatively thin, less than eight inches thick, and preferably less than six inches thick.

In conclusion, it is to be understood that the foregoing descriptions an accompanying drawings relate to preferred embodiments of the present invention. Various changes and modifications may be employed without departing from the spirit and scope of the invention. Thus, by way of example and not of limitation the sub-unit and the housing may be provided with initial support, guiding, and alignment construction other than the flanges and slots, such as multiple mating pins and recesses, with quick release arrangements holding the sub-unit in place. Accordingly, the present invention is not limited to the embodiment shown in the drawings and described hereinabove in the Detailed Description.

What is claimed is:

1. A refrigeration system including a self contained refrigeration unit for mounting in a food storage cabinet or structure, comprising:

a refrigeration unit including a housing containing evaporation tubing and cooling vanes;

said housing being relatively thin and having a depth of not more than six inches;

said housing having an air inlet at the bottom thereof, and a fan and an outlet toward the top of said housing for directing cold air from the refrigeration unit into the food storage structure;

the refrigeration unit being structurally independent of and located wholly within the food storage structure;

a separate compressor and condenser located outside of said food storage structure, and coupled to said refrigeration unit by conduits;

an expansion valve located in said housing near said air inlet, for receiving cooled compressed refrigerant and supplying cold expanded refrigerant to said tubing for heat exchange utilizing said cooling vanes; and said fan and an associated electric motor forming a sub-unit, said sub-unit being readily removable from said housing as an integral sub-unit, wherein an additional fan is mounted as part of said sub-unit, for cooling said electric motor.

2. A refrigeration system including a self contained refrigeration unit for mounting in a food storage cabinet or structure, comprising:

a refrigeration unit including a housing containing evaporation tubing and cooling vanes;

said housing being relatively thin and having a depth of not more than six inches;

said housing having an air inlet at the bottom thereof, and a fan and an outlet toward the top of said housing for directing cold air from the refrigeration unit into the food storage structure;

the refrigeration unit being structurally independent of and located wholly within the food storage structure;

a separate compressor and condenser located outside of said food storage structure, and coupled to said refrigeration unit by conduits;

an expansion valve located in said housing near said air inlet, for receiving cooled compressed refrigerant and supplying cold expanded refrigerant to said tubing for heat exchange utilizing said cooling vanes; and said fan and an associated electric motor forming a sub-unit, said sub-unit being readily removable from said housing as an integral sub-unit, wherein said sub-unit has two metal flanges, and wherein said housing has mating slots for receiving said flanges.

3. A refrigeration system including a self contained refrigeration unit for mounting in a food storage cabinet or structure, comprising:

a refrigeration unit including a housing containing evaporation tubing and cooling vanes;

said housing being relatively thin and having a depth of not more than six inches;

said housing having an air inlet at the bottom thereof, and a fan and an outlet toward the top of said housing for directing cold air from the refrigeration unit into the food storage structure;

the refrigeration unit being structurally independent of and located wholly within the food storage structure;

a separate compressor and condenser located outside of said food storage structure, and coupled to said refrigeration unit by conduits;

an expansion valve located in said housing near said air inlet, for receiving cooled compressed refrigerant and supplying cold expanded refrigerant to said tubing for heat exchange utilizing said cooling vanes; and said fan and an associated electric motor forming a sub-unit, said sub-unit being readily removable from said housing as an integral sub-unit, wherein said sub-unit is mounted to said housing on tracks, and quick release arrangements are provided for holding said sub-unit into said housing and wherein said quick release arrangements include two springy metal strips for biasing said sub-unit into engagement with said housing.

4. An efficient refrigeration system comprising:

a refrigeration unit including a housing;

said housing having an input opening and an outlet opening;

evaporation cooling coils, mounted into said housing;

a sub-unit including a centrifugal fan and an electric motor removably mounted into said housing on tracks; said fan drawing air from said input opening, across said cooling coils, and out said outlet opening;

an expansion valve coupled to said cooling coils, said expansion valve being mounted adjacent said input opening; and quick release arrangements for firmly securing said sub-unit in place by exerting force between said sub-unit and said tracks, wherein said tracks provide two slots formed as part of said housing, said sub-unit has outwardly extending flanges to mate with said slots, and wherein the quick release arrangements comprise springy metal strips that are insertable into said slots to hold said flanges and the associated sub-unit in place within said housing.

5. A refrigeration system including a self contained refrigeration unit for mounting in a food storage cabinet or structure, comprising:

a refrigeration unit including a housing;

said housing having an input opening and an outlet opening;

evaporation cooling coils, mounted into said housing;

a sub-unit including a centrifugal fan and an electric motor removably mounted into said housing on tracks; said fan drawing air from said input opening, across said cooling coils, and out said outlet opening wherein an additional fan is mounted as part of said sub-unit, for cooling said electric motor;

an expansion valve coupled to said cooling coils, said expansion valve being mounted adjacent said input opening; and quick release arrangements for firmly securing said sub-unit in place by exerting force between said sub-unit and said tracks.

6. A refrigeration system including a self contained refrigeration unit for mounting in a food storage cabinet or structure, comprising:

a refrigeration unit including a housing containing evaporation tubing and cooling vanes;

said housing being relatively thin and having a depth of not more than six inches;

said housing having an air inlet at the bottom thereof, and a fan and an outlet toward the top of said housing for directing cold air from said refrigeration unit into said food storage structure;

said refrigeration unit being structurally independent of and located wholly within the food storage structure;

a separate compressor and condenser located outside of said food storage structure, and coupled to said refrigeration unit by conduits;

said fan and an associated electric motor forming a sub-unit, said sub-unit being readily removable from said housing as an integral sub-unit, wherein an additional fan is mounted as part of said sub-unit, for cooling said electric motor.

7. A refrigeration system comprising:

a refrigeration unit including a housing;

said housing having an input opening and an outlet opening;

evaporating cooling coils, mounted into said housing;

a sub-unit including a fan and an electric motor removably mounted into said housing on a guiding, supporting and alignment construction, wherein said guiding, supporting and alignment construction includes flanges on said sub-unit and slots on said housing; said fan drawing air from said input opening, across said cooling coils, and out said outlet opening; and quick release arrangements for firmly securing said sub-unit in place by exerting force between said sub-unit and said housing.

8. A refrigeration system as defined in claim 7 wherein said quick release arrangements include springy metal strips biasing each of said flanges toward one side of one of said slots.

9. A refrigeration system comprising:

a refrigeration unit including a housing;

said housing having an input opening and an outlet opening;

evaporating cooling coils, mounted into said housing;

a sub-unit including a fan and an electric motor removably mounted into said housing on a guiding, supporting and alignment construction; said fan drawing air from said input opening, across said cooling coils, and out said outlet opening; and wherein an additional fan for cooling said motor forms part of said sub-unit; and quick release arrangements for firmly securing said sub-unit in place by exerting force between said sub-unit and said housing.

* * * * *